US005855178A

United States Patent [19]

Treu et al.

[11] Patent Number: 5,855,178

[45] **Date of Patent: *Jan. 5, 1999**

[54] TAUT LEG MOORING SYSTEM

[75] Inventors: Johannes Jacobus Treu, Bellville; Peter George Scott Dove, Houston, both of Tex.

[73] Assignee: Aker Marine, Inc., Houston, Tex.

[ * ] Notice: The term of this patent shall not extend beyond the expiration date of Pat. No. 5,704,307.

[21] Appl. No.: 961,168

[22] Filed: Oct. 30, 1997

Related U.S. Application Data

[63] Continuation-in-part of Ser. No. 745,865, Nov. 8, 1996, Pat. No. 5,704,307, which is a continuation of Ser. No. 615,120, Mar. 13, 1996, abandoned.

[51] Int. Cl.[6] ..... B63B 21/00

[52] U.S. Cl. ..... 114/230; 114/293; 441/3

[58] Field of Search ..... 441/3–5; 114/230, 114/293, 294

[56] References Cited

U.S. PATENT DOCUMENTS

| | | | |
|---|---|---|---|
| 3,295,489 | 1/1967 | Bossa | 114/230 |
| 3,540,396 | 11/1970 | Horton | 114/230 |
| 3,602,174 | 8/1971 | Gorman | 441/4 |
| 3,703,151 | 11/1972 | Clement | 114/230 |
| 4,086,866 | 5/1978 | Nixon et al. | 114/295 |
| 4,257,721 | 3/1981 | Haynes | 405/227 |
| 4,318,641 | 3/1982 | Hogervorst et al. | 405/224 |
| 4,347,012 | 8/1982 | Glidden | 114/230 |
| 4,733,993 | 3/1988 | Andreasson | 405/224 |
| 5,041,038 | 8/1991 | Poldervaart et al. | 114/230 |
| 5,159,891 | 11/1992 | Lohr et al. | 114/230 |

OTHER PUBLICATIONS

Telefax memo from Applicant Aker Marine to Shell Offshore dated May 7, 1991.

Telefax memo from Applicant Aker Marine to Shell Offshore dated Jun. 17, 1991.

*Primary Examiner*—Stephen Avila

*Attorney, Agent, or Firm*—Michael A. O'Neil

[57] ABSTRACT

A taut leg bow mooring system includes an anchor positionable on the floor of the sea. A riser line is normally secured to and extends upwardly from the anchor, and a submerged buoy is secured to the end of the riser line remote from the anchor. A line extends upwardly from the submerged buoy to a surface buoy. A mooring line is pivotally connected in the line extending from the submerged buoy to the surface buoy.

10 Claims, 13 Drawing Sheets

TAUT LEG MOORING SYSTEM

RELATED APPLICATION

This application is a continuation-in-part of application Ser. No. 08/745,865, filed Nov. 8, 1996, now U.S. Pat. No. 5,704,307 which is a continuation of application Ser. No. 08/615,120 filed Mar. 13, 1996, now abandoned.

TECHNICAL FIELD

This invention relates generally to systems for mooring supply boats and similar vessels relative to offshore drilling and/or production platforms and the like and, more particularly, to a taut leg bow mooring system for supply boats and similar vessels.

BACKGROUND OF THE INVENTION

Heretofore, supply boats and similar vessels have typically been moored to offshore drilling and/or production platforms and similar structures utilizing catenary-type mooring systems. Although adequate for shallow water applications, catenary-type mooring systems are unsatisfactory for use in deep water applications.

One problem associated with the use of catenary-type systems to affect bow mooring of supply boats and similar vessels involves the repetitive flexing of the components of the mooring system on or near the sea floor due to the action of tides, waves, currents, etc. The flexing of the component parts of a catenary-type mooring system results in increased wear, which in turn results in reduced service life of the system. This problem is compounded by the fact that the flexing of the component parts of a catenary-type mooring system is most pronounced in the components of the system situated near the sea floor. Thus, when a catenary-type mooring system is used in deep water, it is impossible for divers to descend deep enough to inspect and repair the component parts of the system which are the most subject to wear. Currently, a deep water catenary mooring system is typically inspected at 12 to 24 month intervals by retrieving the system, inspecting the system on board the retrieving vessel, and replacing worn components.

A more significant problem attendant to the use of catenary-type bow mooring systems in deep water applications involves the fact that catenary-type mooring systems do not provide sufficient stiffness to prevent the moored vessel from drifting too close to the adjacent structure. Because the catenary-type mooring system cannot apply sufficient force to keep the vessel properly positioned relative to the adjacent structure, the propulsion system of the vessel must be regularly used to keep the vessel clear of the adjacent structure. Present mooring systems are not satisfactory due to the increased costs of fuel consumption to operate the supply vessel's propulsion system and the risk of collision with the platform in case of a propulsion failure due to human error or equipment problems.

SUMMARY OF THE INVENTION

The present invention comprises a taut leg bow mooring system which overcomes the foregoing and other disadvantages associated with the prior art. In accordance with the broader aspects of the invention, a clump weight anchor is positioned on the sea floor. Other anchor types suitable for vertical loading may also be used. A riser wire extends upwardly from the anchor and is connected to a submerged buoy. A buoyant line extends from the submerged buoy to a surface buoy and a floating hawser extends from the surface buoy for connection to the anchor chain or bow mooring wire of a supply boat or similar vessel to be moored.

The use of the invention is advantageous in that taut leg mooring systems constructed in accordance therewith provide sufficient stiffness to eliminate the necessity of using the vessel propulsion system to keep the moored vessel clear of the adjacent structure in 6–8 foot seas. The use of the invention also eliminates the wear problems at the sea floor associated with the use of catenary-type mooring systems in deep water applications, and therefore extends the service life of the submerged part of the taut leg bow mooring to many times that of a catenary system.

BRIEF DESCRIPTION OF THE DRAWINGS

A more complete understanding of the invention may be had by reference to the following Detailed Description taken in conjunction with the accompanying Drawings, wherein.

DETAILED DESCRIPTION

Figure 1:
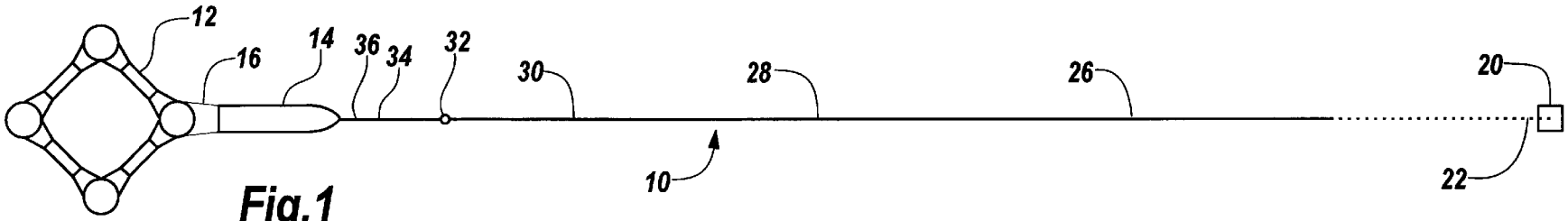
Fig.1 (PRIOR ART)
FIG. 1 is a plan view of a catenary-type mooring system.
Figure 2:
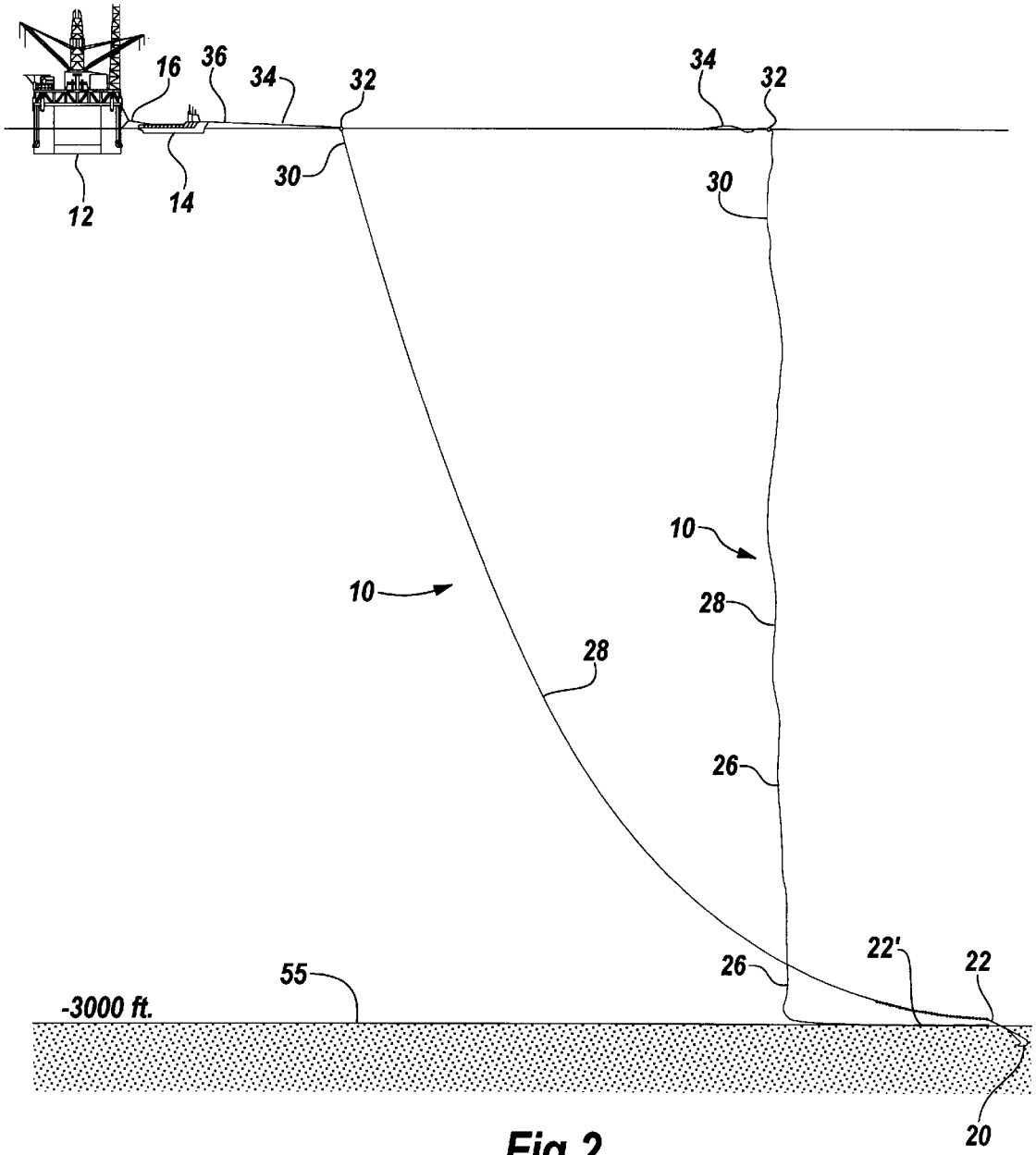
Fig.2 (PRIOR ART)
FIG. 2 is an elevation view of the catenary-type mooring system of FIG. 1.

Referring now to the Drawings, and particularly to FIGS. 1 and 2 thereof, there is shown a prior art catenary-type bow mooring system 10. An offshore drilling and/or production platform 12 is situated at a location in the sea where the water depth is approximately 3,000 feet or more. Goods and services are provided to the platform 12 and empty containers, trash and waste are removed from the platform 12 by means of supply boats 14 and similar vessels.

The vessels 14 are connected to the platform 12 utilizing the stern mooring apparatus 16. A catenary-type bow mooring system 10 is connected to the bow of the vessel 14, and is used to apply an outwardly directed force to the vessel 14 tending to pull the vessel 14 away from the platform 12. In theory, the bow mooring system 10 keeps the stern mooring apparatus 16 constantly in tension, thereby preventing engagement between the vessel 14 and the adjacent platform 12.

In actual practice, catenary-type mooring systems do not perform adequately, particularly in deep water applications. Catenary-type mooring systems lack adequate stiffness and therefore the outwardly directed force does not increase rapidly enough when environmental forces push the vessel toward the platform. In order to maintain adequate clearance it is necessary to operate the propulsion system of the moored vessel even in mild sea conditions in order to prevent inadvertent contact between the vessel and the adjacent structure.

Referring now to FIG. 2, the catenary-type mooring system 10 is shown in greater detail. A drag embedment anchor 20, which may be of the type manufactured by Bruce, engages the sea floor. The mooring system 10 may also employ other commercially available drag embedment anchors. A 450 to 500-foot long, 3-inch diameter chain 22 is secured to and extends from the anchor 20. A 650-foot long, 2.5 inch diameter ground wire 26 is secured to and extends from the chain 22. A 2,700-foot long, 2-inch diameter riser wire 28 is secured to and extends from the ground wire 26. A 40-foot long, 2-inch diameter connection pendant wire 30 is secured to and extends from the riser wire 28.

An 85 kip net buoyancy surface buoy 32 is secured to the connection pendant wire 30 and floats on the surface of the sea. A 200-foot, 3-inch diameter hawser 34 is secured to and extends from the buoy 32. A bow mooring wire 36, having a length of about 200 feet and deployed from the vessel, interconnects the floating hawser 34 and the bow of the vessel 14. As indicated above, the stern mooring apparatus 16 interconnects the stern of the vessel 14 and the platform 12.

FIG. 2 also illustrates the catenary-type bow mooring system 10 when it is not connected to the vessel. As illustrated in the right-hand portion of FIG. 2, when the system is not in use a second difficulty inherent in the use of catenary-type mooring systems is that the surface buoy 32 is constantly in motion under the action of tides, waves, currents, etc. Movement of the buoy 32 causes flexure of the component parts of the mooring system 10, particularly the ground wire 26 near the sea floor. Since the components of the catenary-type mooring system 10 most subject to flexing are situated approximately 3,000 feet below the surface of the sea, it is therefore necessary to recover the mooring system 10 to the surface at approximately 12 to 24-month intervals in order to inspect the component parts thereof and replace any worn components.

Figure 3:
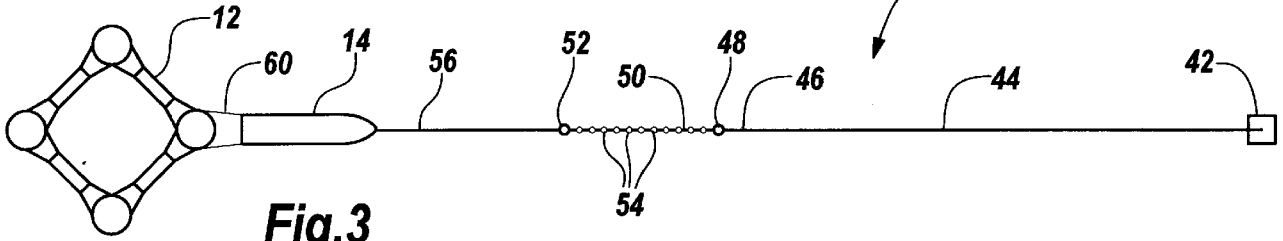
FIG. 3 is a plan view of a taut leg mooring system incorporating a first embodiment of the present invention.
Figure 4:
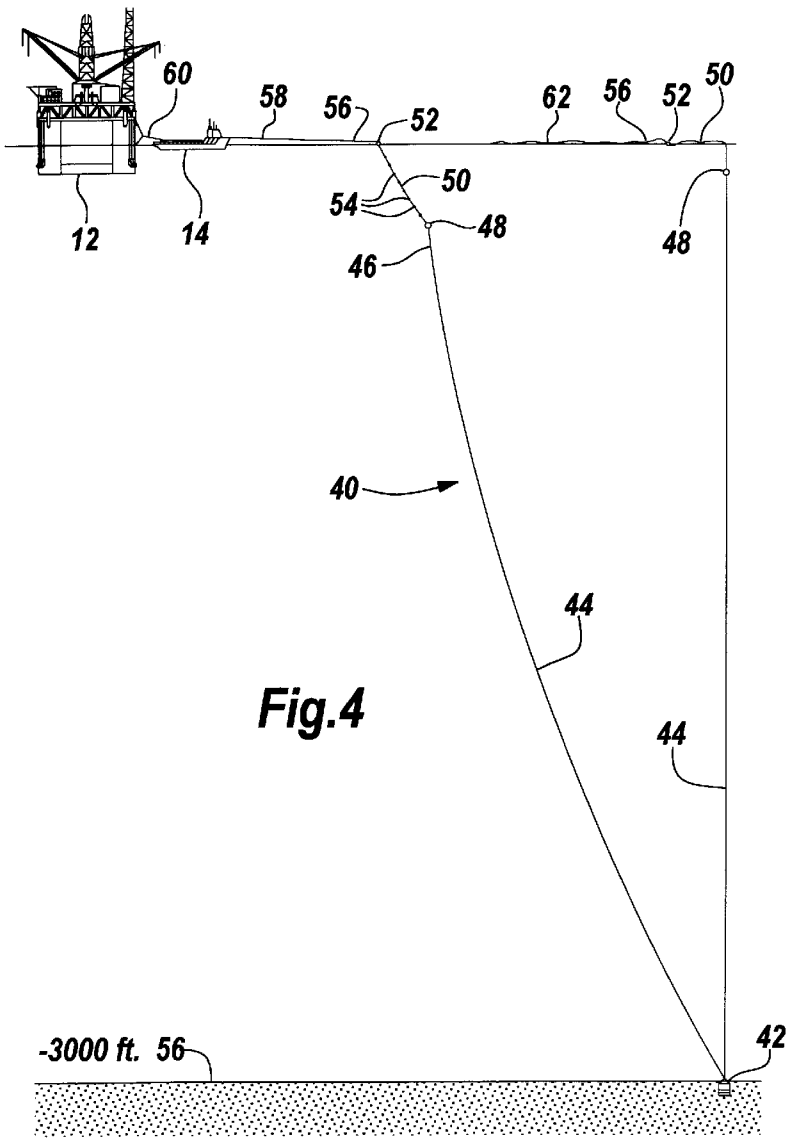
FIG. 4 is an elevation view of the taut leg mooring system of FIG. 3.
Figure 5:
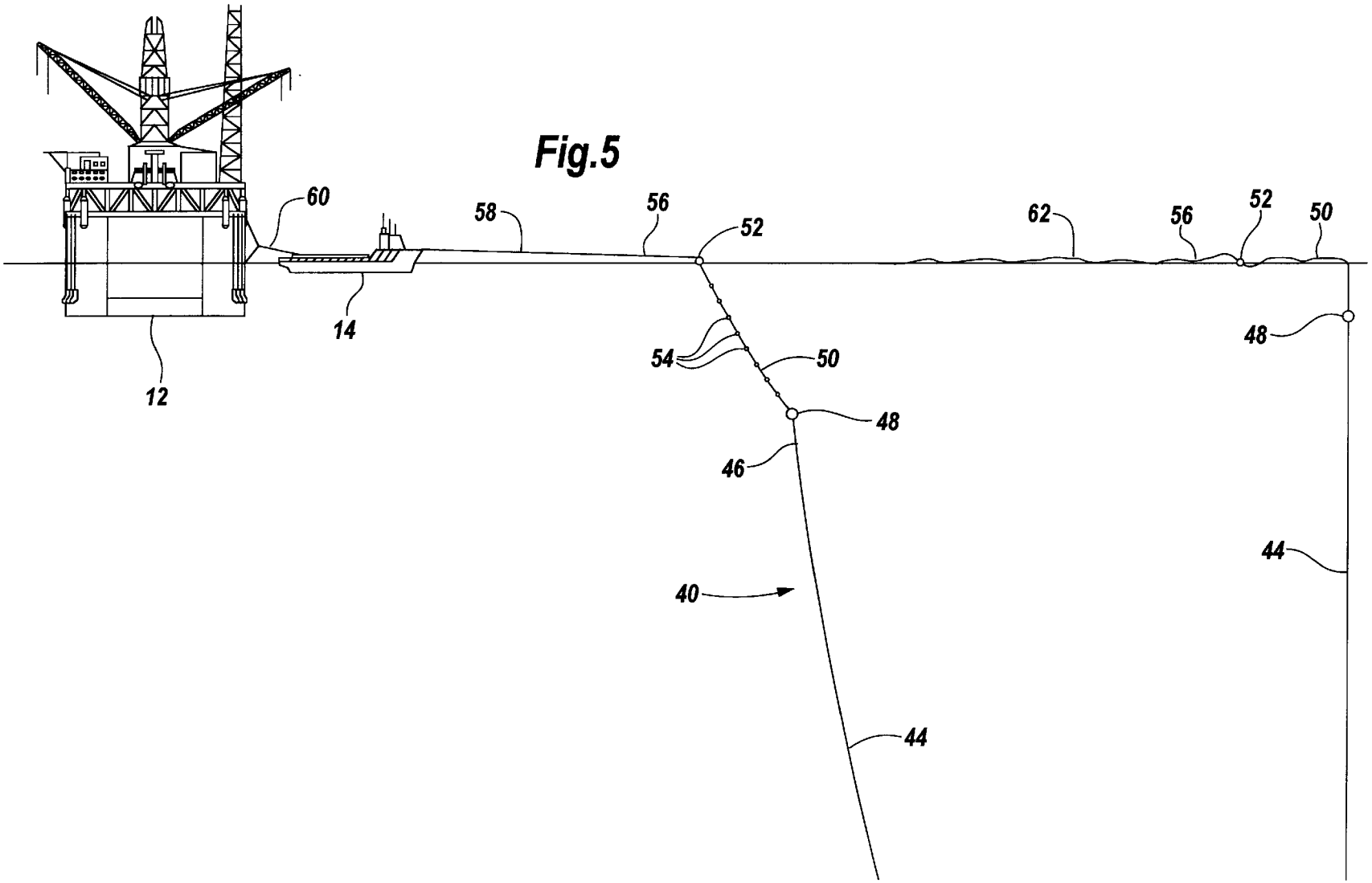
FIG. 5 is an enlargement of the upper portion of FIG. 4.

Referring now to FIGS. 3–5, a taut leg bow mooring system 40 incorporating the present invention is illustrated in use with a semi-submersible drilling and/or production platform 12 in approximately 3000 feet of water. It will be understood, however, that the system of the present invention may be used in varying water depths and with fixed and/or floating marine structures and/or vessels.

The system 40 includes a clump-weight anchor 42, which preferably comprises a steel tank filled with hematite ballast. In the embodiment shown, the anchor 42 has a submerged weight of between about 60 and about 75 tons. The weight of the anchor is determined by the maximum uplift loads of the system. Other anchors capable of sustaining a vertical load may be used in the practice of the invention in lieu of the clump-weight anchor 42, including suction anchors, anchor piles, and vertical loaded anchors.

A riser wire 44 is secured to and extends upwardly from the anchor 42. The riser wire 44 is approximately 2,885 feet in length and has a diameter of approximately 2.25 inches. The riser wire 44 may comprise a non-jacketed galvanized spiral strand wire rope equipped with zinc anode wires in the outer layer and internally filled with an amorphus polypropylene blocking compound. The service life for a riser wire of this type is between about 10 to about 15 years. Alternatively, the riser wire 44 may comprise galvanized spiral strand wire rope sheathed by a high density polyethylene jacket. Spiral strand wire rope having a high density polyethylene jacket is more expensive as compared with non-jacketed galvanized spiral strand wire rope equipped with anode wires, but has a service life of between about 20 to about 30 years. Still other options for use in the construction of the wire riser 44 comprise six-strand wire rope or synthetic rope. For example, the riser wire 44 could comprise a synthetic rope formed from high strength/low stretch aramid fibers, of the type available from DuPont under the trade name Kevlar™.

A 15-foot long, 3-inch diameter chain 46 and swivel is secured to and extends from the riser wire 44. A 45 kip net buoyancy submerged buoy 48 is secured to the chain 46. The submerged buoy 48 is sized to provide sufficient net buoyancy to keep the riser wire 44 of the mooring system in tension and in a substantially vertical position when not in use. For optimum performance to the system 40 the buoyancy of submerged buoy 48 is typically 10 to 20 kips in addition to the weight of the riser wire 44 and chain 46. The submerged buoy 48 comprises a drum formed from steel or from a body of synthetic material such as syntactic foam or a PVC foam with a protective cover. A floating connection line 50 extends between the submerged buoy 48 and a surface buoy 52. The line 50 may comprise a length of wire rope equipped with buoyancy collars 54 or, alternatively, the line 50 may comprise a length of 8-inch circumference buoyant synthetic line of high-strength/low stretch fiber of the type sold by Allied Fibers under the trademark SPECTRA™. Line of this type has a density such that it floats on the surface of salt water to minimize entanglement with the submerged buoy 48. A 300-foot, 10inch circumference TQ12™ hawser 56, available from Bridon, is secured to and extends from the surface buoy 52.

The net buoyancy uplift of the surface buoy 52 is sized to prevent submergence of the surface buoy at the maximum vessel offset. It has been demonstrated that when the surface buoy becomes submerged, the stiffness in the system decreases dramatically. In the embodiment disclosed in FIGS. 3–5 the buoyancy of the surface buoy 52 is approximately 95 to 100 kips. Experimental data has demonstrated a ratio of the buoyancy of the surface buoy 52 to the buoyancy of the submerged buoy 48 of approximately 2 to 1 produces optimum stiffness in the system 40. The surface buoy 52 comprises a polyurethane foam filled hollow steel drum or a polyurethane foam body with synthetic outer skin.

A 1.25 inch diameter bow wire 58 is connected between the hawser 56 and a winch on the bow of the vessel 14. A wishbone-type or other suitable stern mooring apparatus 60 is secured between the stern of the vessel 14 and the adjacent platform 12.

The performance of the taut leg bow mooring system 40 of the present invention under service conditions is vastly superior to that of the catenary-type bow mooring system illustrated in FIG. 2. Stiffness in a mooring system may be defined as the increase in bow mooring tension per unit of boat displacement, similar to the manner in which spring stiffness is defined. A typical catenary mooring system has a stiffness of approximately 150 lbs/ft. A taut leg mooring system of the present invention may have a stiffness of 450 lbs/ft or more. Therefore, the bow mooring system of the present invention provides an increased stiffness of between about 300 and 350 percent as compared with a corresponding catenary-type bow mooring system. Because of its significantly increased stiffness, the taut leg bow mooring system of the present invention provides a significantly improved outwardly directed force to the bow of the moored vessel of sufficient magnitude to maintain the stern mooring apparatus in tension, thereby preventing contact between the vessel and the adjacent structure without requiring the use of the vessel propulsion system in 6–8 foot sea conditions.

FIG. 4 also illustrates the taut leg bow mooring system when it is not connected to a vessel. As illustrated in the right-hand portion of FIG. 4, when the system 40 is not connected to a vessel, the riser wire 44 extends substantially vertically. The submerged buoy 48 is situated approximately 100 feet below the surface of the sea and is therefore not subject to wave action. Most of the connection line 50, the surface buoy 52 and the hawser 56 float on the surface of the sea awaiting connection to a vessel 14. A pick-up line 62 is normally secured to the hawser 56.

Because the submerged component parts of the taut leg mooring system 40 are oriented vertically and are always in tension when the system is not in use, the component parts thereof are not subject to flexure under the action of tides, waves, currents, etc. Therefore, the damaging wear at the sea floor, which is characteristic of catenary-type mooring systems, is not experienced in the use of taut leg mooring systems incorporating the present invention.

An additional advantage of the taut leg mooring system over the catenary mooring systems is illustrated in FIGS. 1 and 3. As can be seen a taut leg system positions the anchor 42 closer to the platform 12 than then anchor 20 is positioned to the platform 12. It is desirable to have the anchor as close as possible to the platform because it minimizes interference with pipelines on the sea floor. The fact that the taut leg mooring system only occupies a small area of the bottom (the anchor only) further minimizes pipeline interference problems. Additionally, when not in use, strong currents may displace the catenary system ground wire 26 and chain 22 along the bottom of the sea floor, carrying the surface buoy and hawser farther away from the platform. Therefore when a vessel to be moored attaches to the hawser it may have a substantially greater distance to back up toward the platform. As discussed above, with reference to the right-hand side of FIG. 4, when not in use the taut leg mooring system of the present invention is not displaced along the sea floor and therefore the surface buoy and hawser are not as subject to drift away from the platform.

Additionally, many semi-submersible and other types of floating platforms have a spread mooring system for the platforms themselves. These platform mooring systems may contain 8 to 12 and sometimes more mooring lines spread around the perimeter of the platform. As discussed above, catenary-type supply boat mooring systems are subject to drift. If the catenary mooring riser line drifts it may contact the platform mooring lines and cause damage to the platform mooring lines and/or the supply boat mooring line. Because the taut leg mooring system of the present invention is not subject to drift, the possibility for contact with the platform mooring lines is virtually eliminated.

Figure 6:
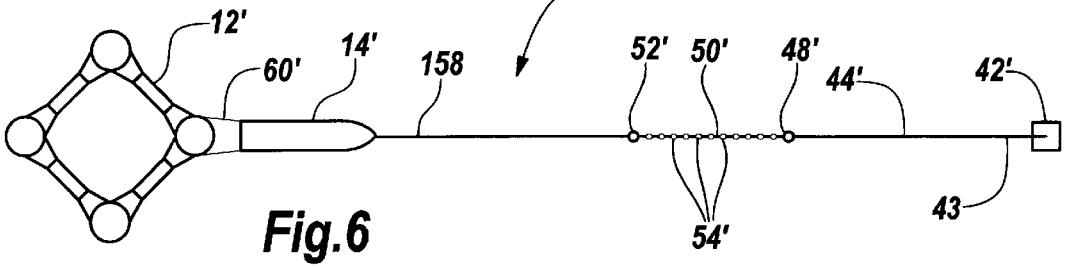
FIG. 6 is a plan view of a taut leg mooring system incorporating an alternative embodiment of the present invention.
Figure 7:
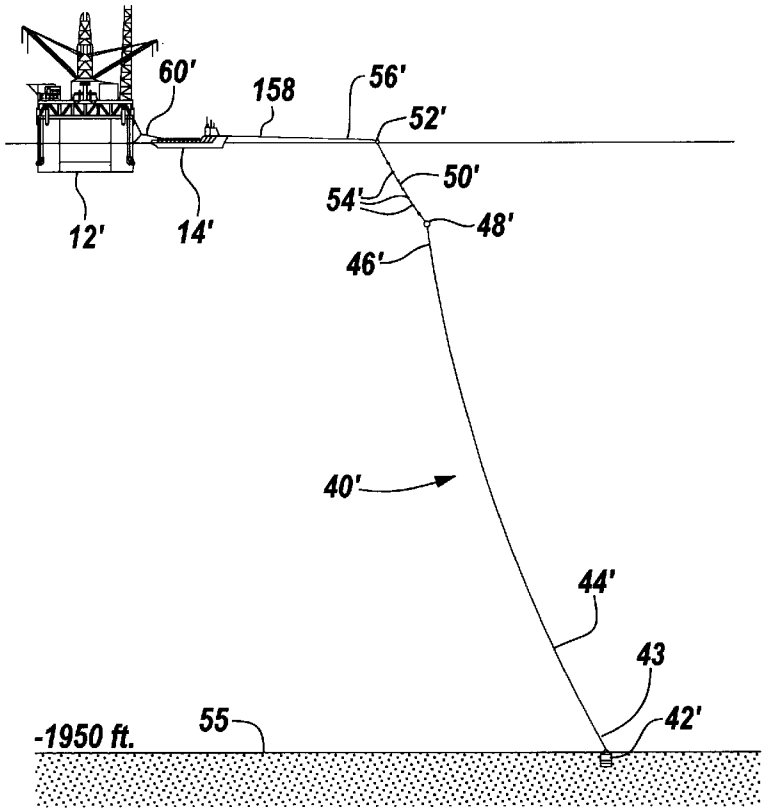
FIG. 7 is an elevation view of the alternative taut leg mooring system of FIG. 6.
Figure 8:
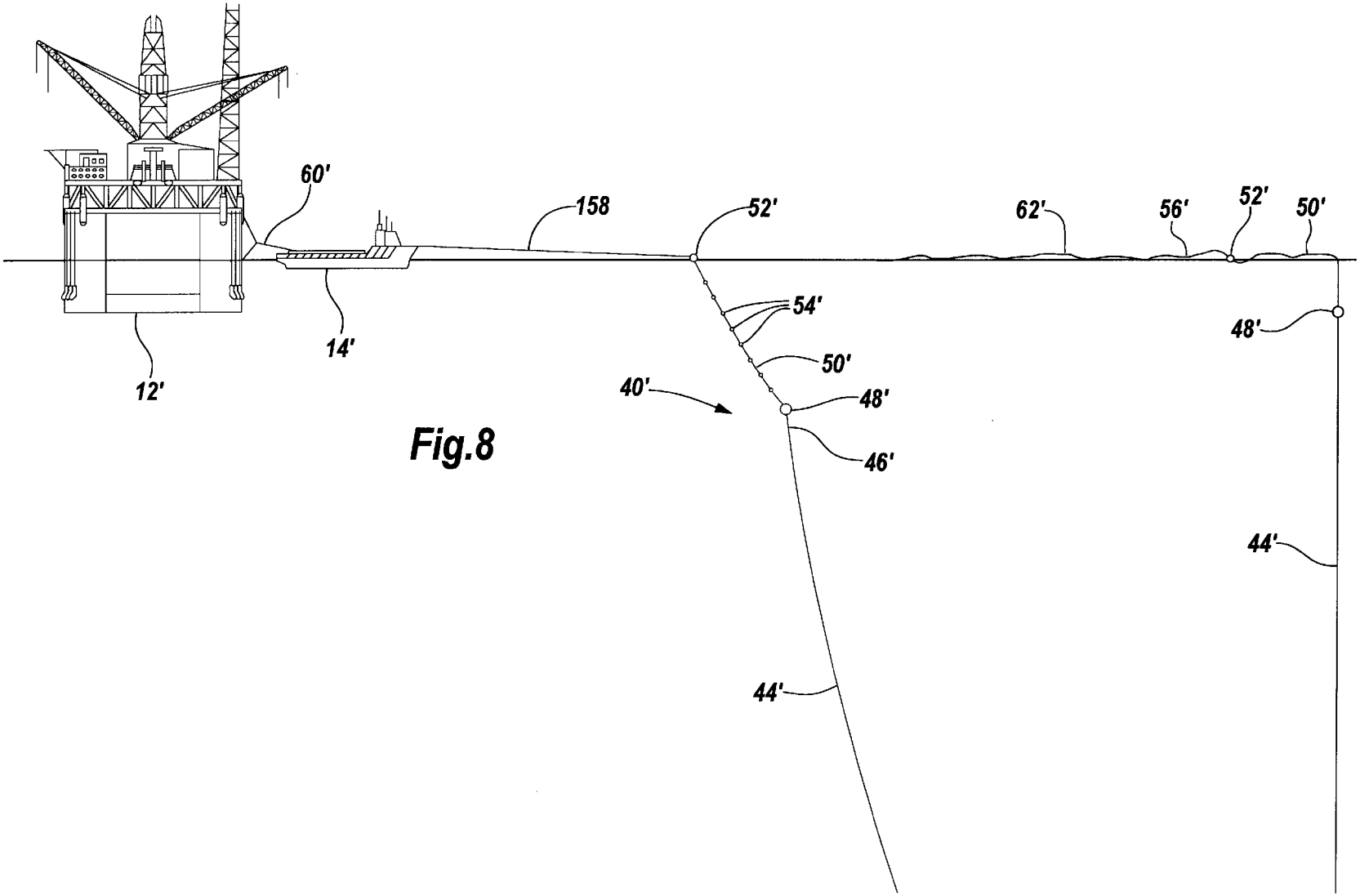
FIG. 8 is an enlargement of the upper portion of FIG. 7.

FIGS. 6–8 illustrate an alternative embodiment of the present invention illustrated in use with a semi-submersible drilling and/or production platform in approximately 1950 feet of water. It will be understood that the present invention may be used with a tension leg drilling and/or production platform and/or other type of moored or bottom supported offshore platforms.

The alternative embodiment incorporates many important parts of the preferred embodiment that are substantially identical in construction and function as those illustrated in FIGS. 3–5. Such identical component parts are designated in FIGS. 6–8 with the same reference numerals utilized hereinabove in the description of the preferred embodiment, but are differentiated by means of a prime (') designation. The system 40' includes a clump-weight anchor 42', which preferably comprises a steel tank filled with hematite ballast. In the embodiment shown, the anchor 42' preferably has a submerged weight of about 60 tons. Other anchors capable of sustaining a vertical load may be used in the practice of the invention in lieu of the clump-weight anchor 42', if desired.

A short length of 3-inch diameter chain 43 is secured to the anchor 42'. The chain 43 minimizes flexure in the riser wire 44'. The riser wire 44' is secured to and extends upwardly from the chain 43. The riser wire 44' is approximately 1,800 feet in length and has a diameter of approximately 2.125 inches. A short length, approximately 15-foot long, 2.5-inch diameter chain 46' is secured to and extends from the riser wire 44'. A 30 kip net buoyancy submerged buoy 48' is secured to the chain 46'. The submerged buoy 48' is sized to provide sufficient net buoyancy to maintain the riser wire in tension and in a substantially vertical position when not in use. For optimum performance of the system 40 the buoyancy of the submerged buoy is typically 10 to 20 kips in addition to the weight of the riser wire 44' chain 43 and chain 46'. A buoyant connection line 50' extends between the submerged buoy 48' and a surface buoy 52'. The line 50' may comprise a length of wire rope equipped with buoyancy collars 54'.

In the embodiment disclosed in FIGS. 6–8, the buoyancy of the surface buoy 52' is approximately 65 kips. Experimental data has demonstrated a ratio of the buoyancy of the surface buoy 52' to the buoyancy of the submerged buoy 48' of at least 2 to 1 produces optimum stiffness in the system.

A 300-foot, floating hawser 56' is secured to and extends from the surface buoy 52'. One hundred feet of boat anchor chain 158 is deployed from the vessel anchor windlass and connects the hawser 56' to the bow of the vessel 14'. A wishbone-type or other suitable stern mooring apparatus 60' is secured between the stern of the vessel 14' and the adjacent platform 12'.

FIG. 8 also illustrates the alternative taut leg bow mooring system 40' when it is not connected to a vessel. As illustrated in the right-hand portion of FIG. 8, when the system 40' is not connected to a vessel 14', the riser wire 44' extends substantially vertically. The submerged buoy 48' is situated approximately 100 feet below the surface of the sea and is, therefore, not subject to wave action. Most of the connection line 50', the surface buoy 52' and the hawser 56' float on the surface of the sea awaiting connection to a vessel 14'. A pick-up line 62' is normally secured to the hawser 56'.

Figure 9:
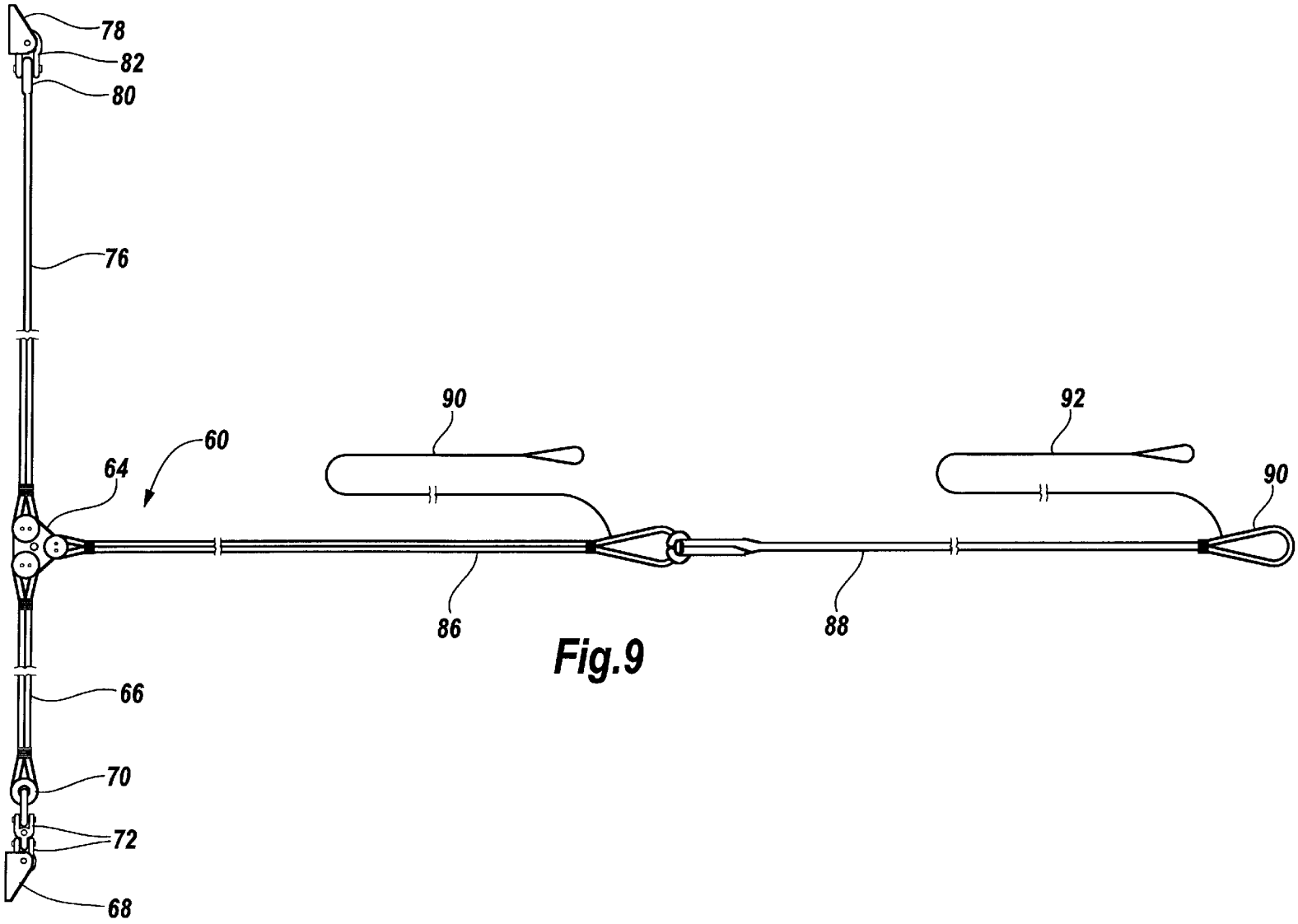
FIG. 9 is an illustration of a typical stern mooring system which may be used in conjunction with the present invention.

A suitable stern mooring apparatus 60 is illustrated in FIG. 9. The stern mooring apparatus 60 of FIG. 9 includes a triplet connector 64. A lower surge line 66 extends downwardly from the connector 64. The lower surge line 66 is connected to a fixture 68 welded to the platform 12 by an eye 70 and shackles 72.

An upper surge line 76 extends upwardly from the connector 64. The upper surge line 76 is connected to a fixture 78 welded to the platform 12 by an eye 80 and a shackle 82. A mooring line 86 also extends from the connector 64. A mooring tail 88 is secured to and extends from the mooring line 86. The mooring line 86 is provided with a recovery line 90, and the mooring tail 88 is provided with a crane pick-up line 92. It will be understood that other types of stern mooring apparatuses may be used in the practice of the invention if desired.

Figure 10:
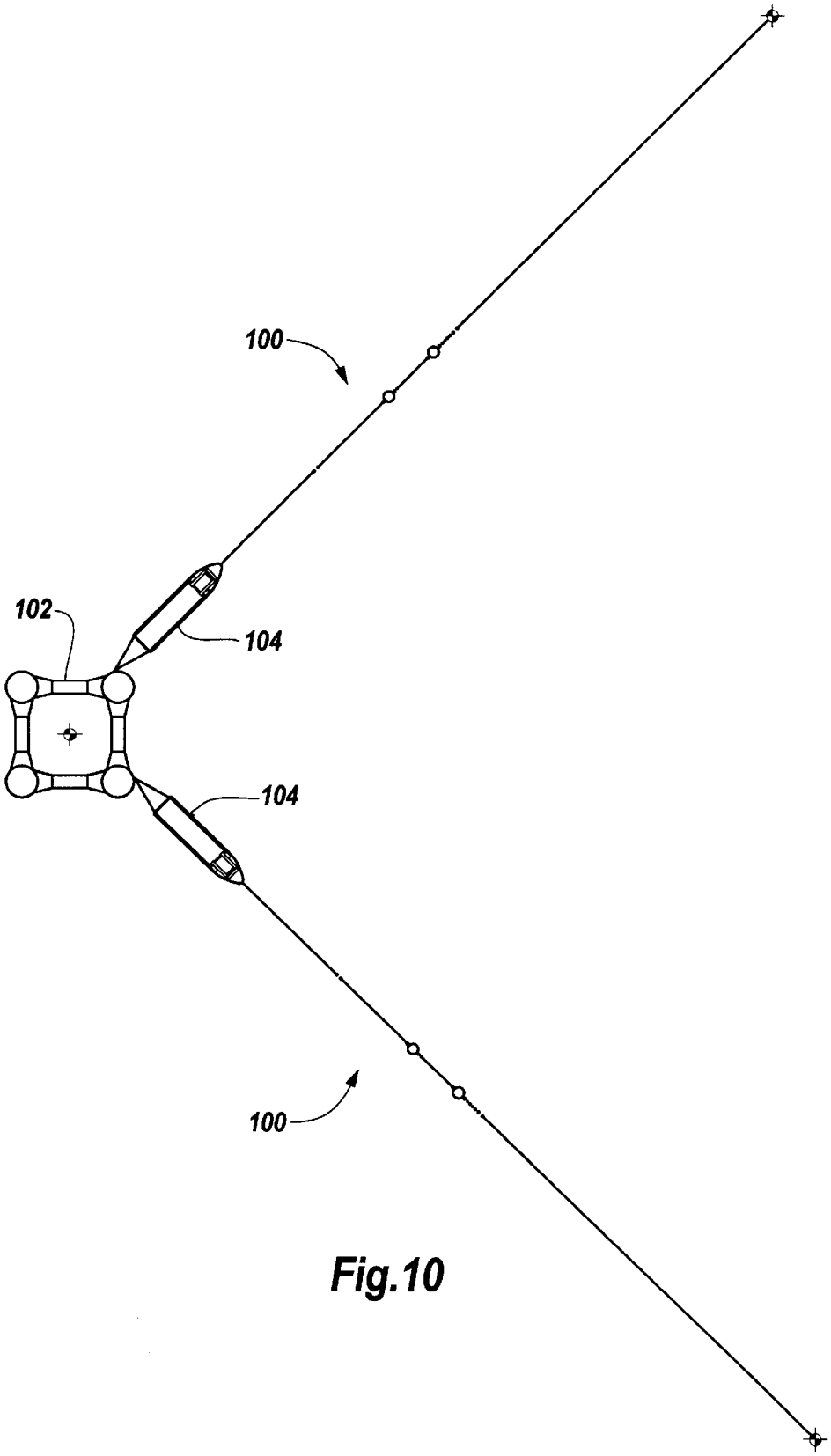
FIG. 10 is a plan view of a taut leg mooring system incorporating a second embodiment of the present invention.
Figure 11:
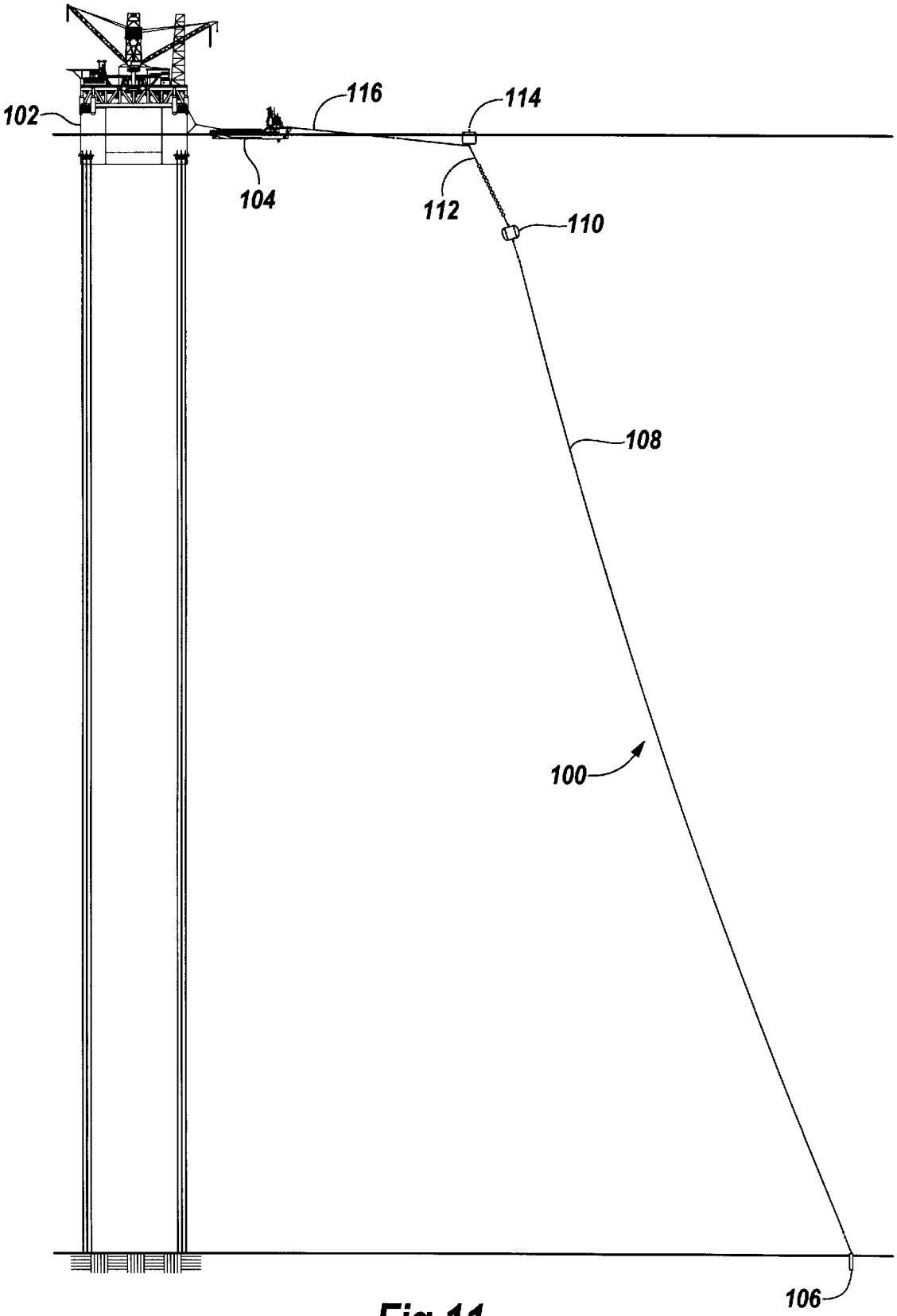
FIG. 11 is an elevational view of the taut leg mooring system of FIG. 10.
Figure 12:
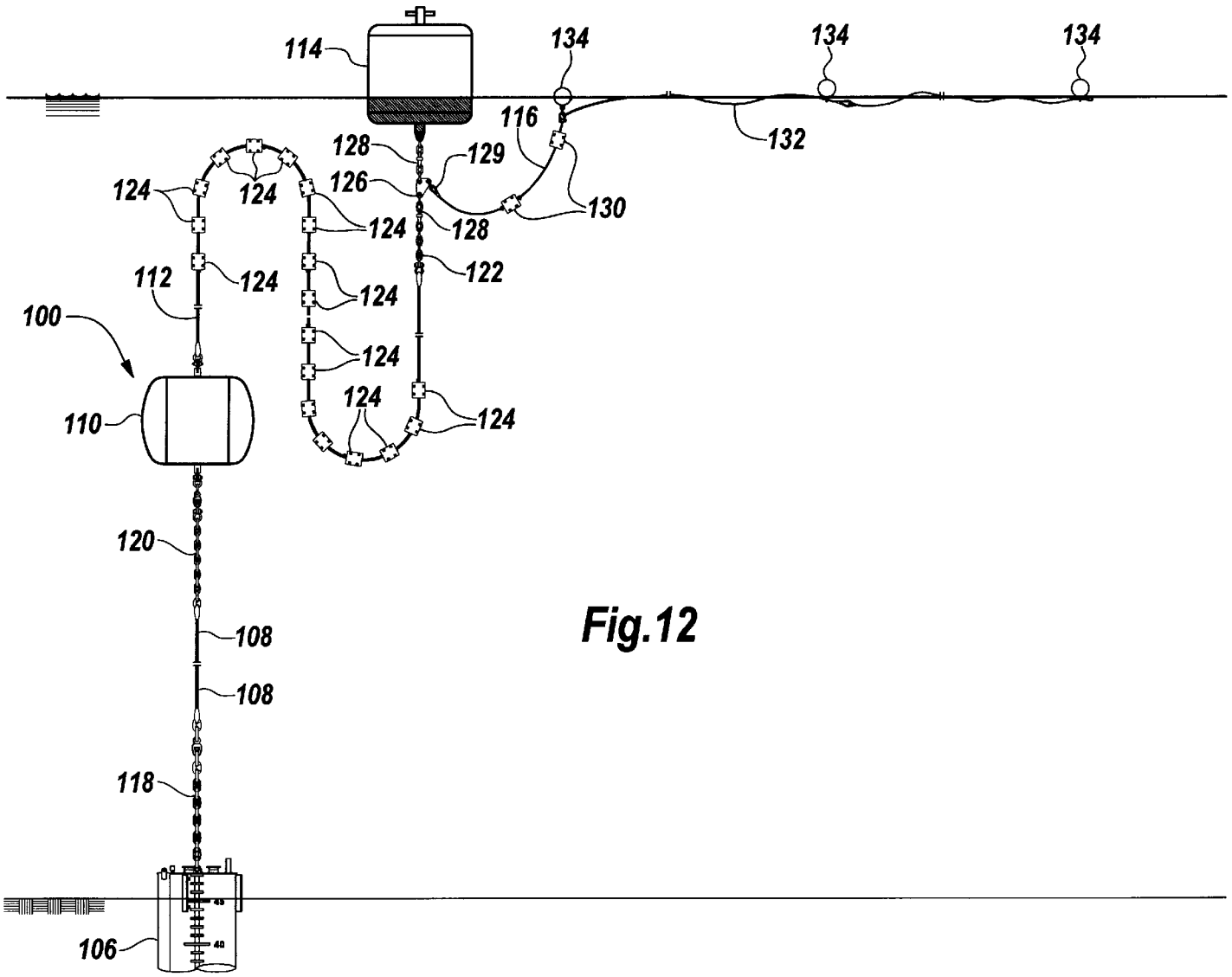
FIG. 12 is an enlargement of a portion of FIG. 11.

Referring now to FIGS. 10, 11, and 12, a taut leg bow mooring system 100 comprising a second embodiment of the invention is shown. A floating production system (FPS) 102 is secured at a location in the ocean or other water body by suitable mooring apparatus. Vessels 104, such as work boats, supply boats, etc., are moored adjacent the FPS 102. The mooring system of FIGS. 10, 11, and 12 is unusual with respect to the stern mooring layout since both wishbone stern moorings are attached to the same points on the FPS column. Normally each vessel 104 would be moored between two columns, and one stern mooring system would be attached to each of the two columns.

The construction and function of the taut leg bow mooring system 100 is further illustrated in FIG. 11. A suction anchor 106 is embedded in the sea floor. A riser line 108 extends upwardly from the suction anchor 106 and is connected at its distal end to a submerged buoy 110. A line 112 secures the submerged buoy 110 to a surface buoy 114. A mooring line 116 extends from the surface buoy to the vessel 104.

As is best shown in FIG. 12, a chain 118 connects the suction anchor 106 to the riser line 108. A chain 120 connects the riser line 108 to the submerged buoy 110. The submerged buoy 110 comprises a hollow steel cylinder which is filled with air.

The line 112 extends from the buoy 110 to a chain 122 which connects the line 112 to the surface buoy 114. A plurality of flotation collars 124 are clamped around the line 112. The buoyancy of the flotation collars 124 combined with the weight of the line 112 is such that the line 112 is normally maintained in a S-shaped configuration as shown when no vessel is moored to the system. The upper curve of the S-configuration is located approximately 30 feet below the surface of the ocean, thereby providing clearance for vessels traveling near the mooring system 100. The use of the flotation collars 124 in conjunction with the line 112 comprises an important feature of the invention in that it prevents the line 112 from becoming twisted around either the submerged buoy 110 or the floating buoy 114.

The chain 112 includes a triangularly shaped plate 126 which is connected into the chain 122 by swivels 128. The line 116 is connected to the triangularly shaped plate 126 by a shackle 129. The swivels 128 prevent the line 116 from twisting about the surface buoy 114. The line 116 is provided with flotation collars 130 which maintain the line 116 in the configuration shown which assists in preventing the line 116 from twisting around the surface buoy 114. The distal end of the line 116 comprises a floating hawser 132 which is identified by marker buoys 134.

Figure 15:
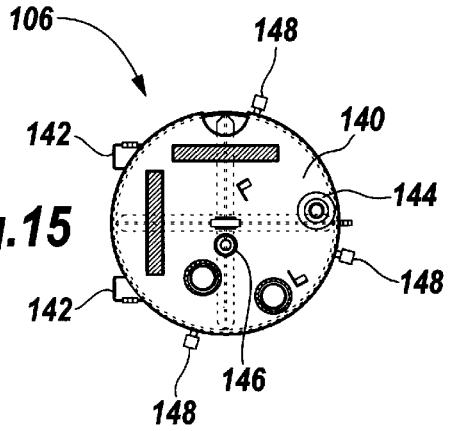
FIG. 15 is a top view of the suction anchor of FIG. 13.
Figure 13:
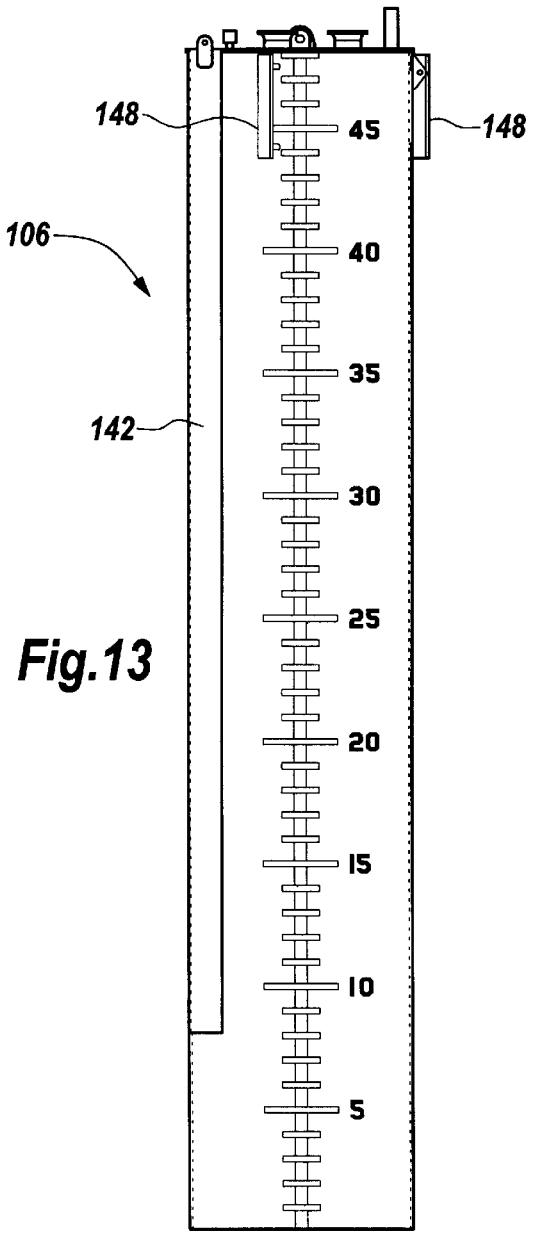
FIG. 13 is a side view of a suction anchor useful in the practice of the invention.
Figure 14:
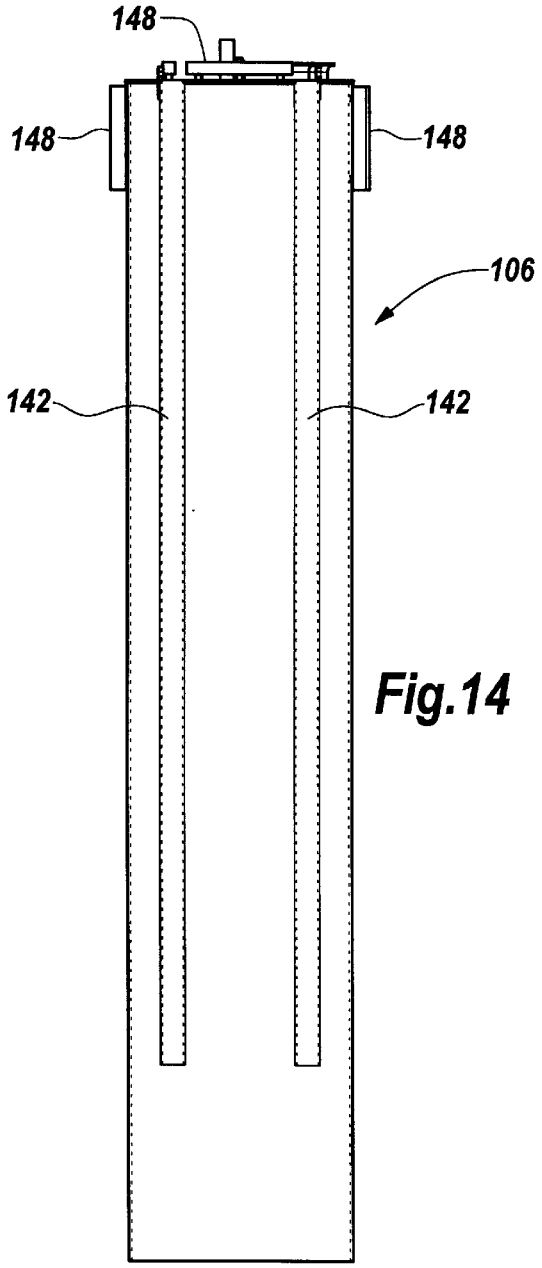
FIG. 14 is an illustration similar to FIG. 13 showing the suction anchor rotated 90 degrees.
Figure 16:
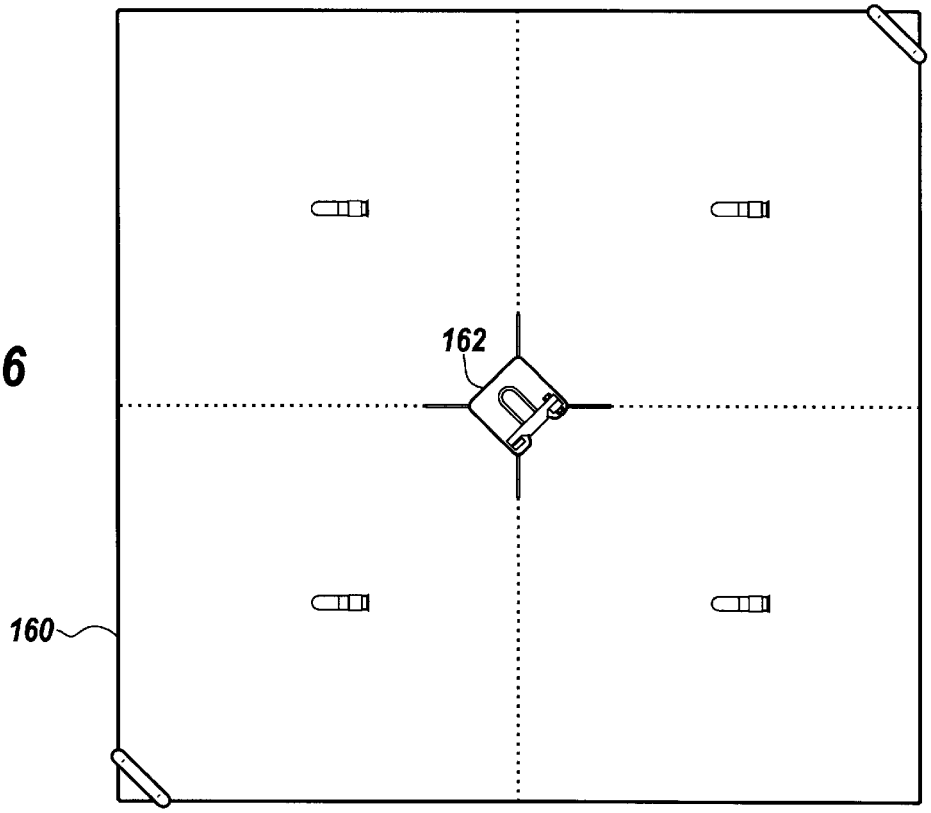
FIG. 16 is a plan view of a anchor tank useful in the practice of the invention.
Figure 17:
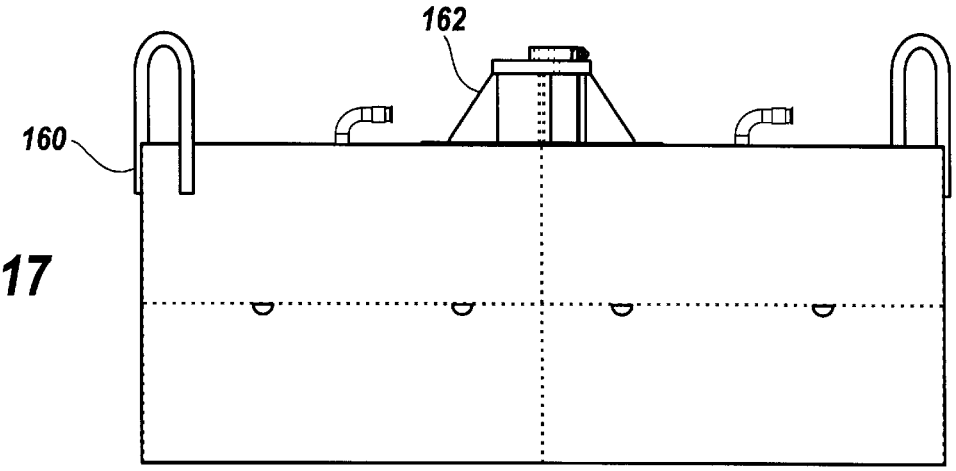
FIG. 17 is an elevational view of the gravity tank of FIG. 16.

The suction anchor 106 is further illustrated in FIGS. 13, 14, and 15. The suction anchor 106 comprises a right circular cylinder formed from steel and having an upper end which is closed by a plate 140. Rails 142 are provided along one side of the circular wall of the suction anchor 106 to prevent the suction anchor from rolling on the deck of an installation vessel.

The upper end of the suction anchor 106 is adapted for engagement by a pumpskid mounted on a remotely operated vehicle (ROV). The pumpskid engages and locks onto a suction port 144, whereupon a pump mounted on the pumpskid and driven by the ROV initially pumps water out of the interior of the suction anchor 106, thereby causing the suction anchor to penetrate into the sea floor. A bullseye level 146 is observable by the ROV to determine the vertical orientation of the suction anchor 106. The suction anchor 106 is provided with a plurality of anodes 148 which function to minimize the corrosive effect of saltwater on the suction anchor 106.

During utilization of the suction anchor 106 as an anchor, that is, during the time that the suction anchor 106 is engaged with the sea floor and serving as a part of the mooring system 100, the ROV and its pumpskid are disengaged therefrom and are utilized for other purposes. Subsequently it may become desirable to recover the suction anchor 106 from the sea floor. At such time the pumpskid on the ROV is reengaged with the port 144 and is utilized to pump water into the suction anchor 106, thereby dislodging the suction anchor 106 from the sea floor recovery.

FIGS. 16, 17, 18, 19, 20, and 21 illustrate a gravity anchor tank 160 having a side entry chain receptacle 162 mounted thereon. In use, the gravity anchor tank 160 is filled with hematite ballast and may be used in lieu of the suction anchor 106 in the construction of the mooring system 100. Although illustrated in conjunction with the gravity anchor tank 160, the side entry chain receptacle 162 may be utilized in conjunction with the suction anchor 106 or in conjunction with other types of anchors.

Figure 19:
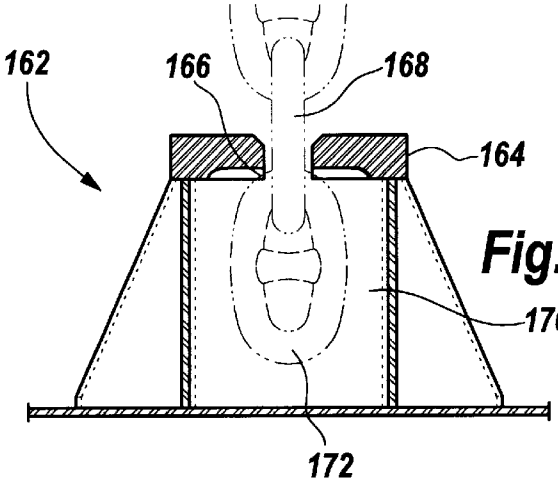
FIG. 19 is a sectional view further illustrating the side entry chain receptacle of FIG. 18.

Referring to FIG. 19, the side entry chain receptacle 162 has an upper plate 164 having a slot 166 formed therein. The slot 166 is dimensioned to receive a chain link 168 therein. The side entry chain receptacle 162 further includes a chamber 170 which receives the next link 172 of the chain comprising the link 168.

Figure 20:
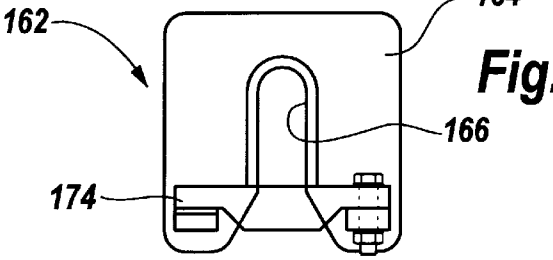
FIG. 20 is a view similar to FIG. 18 further illustrating the construction and operation of the side entry chain receptacle.
Figure 21:
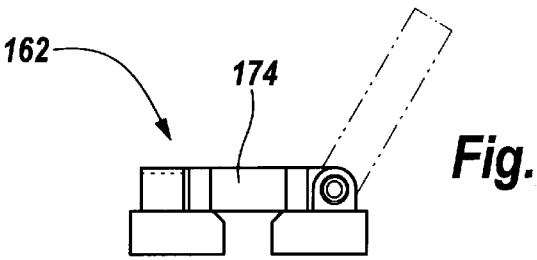
FIG. 21 is a front view of the side entry chain receptacle of FIGS. 18, 19, and 20.
Figure 18:
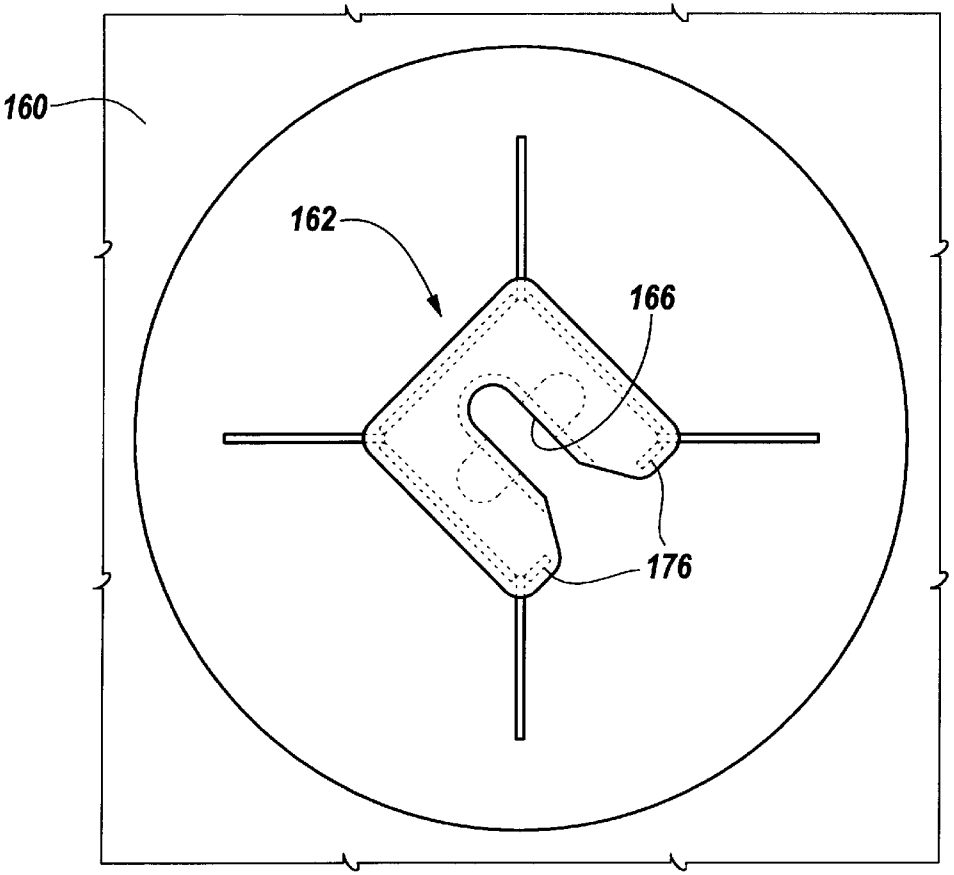
FIG. 18 is an enlargement of a portion of FIG. 16 illustrating the side entry chain receptacle thereof.

As is illustrated in FIGS. 20 and 21, the side entry chain receptacle 162 further includes a door 174 which functions to secure the chain link 168 in the slot 166. The door 174 is illustrated in the closed condition in FIG. 20 and 21, and is also illustrated in the open condition in FIG. 21.

The function of the side entry chain receptacle 162 is to secure the chain comprising the links 168 and 172 to the anchor 160. The door 174 may be opened by the ROV to permit disengagement of the chain from the side entry chain receptacle, and therefore from the anchor 160. This permits servicing of the chain, the riser wire and/or the submerged buoy without the necessity of removing the anchor from the sea floor. After the desired servicing has been completed, the chain can be reengaged with the anchor 160 by positioning the link 168 in the slot 166 and closing the door 174. Again, this is accomplished by the ROV.

Figure 22:
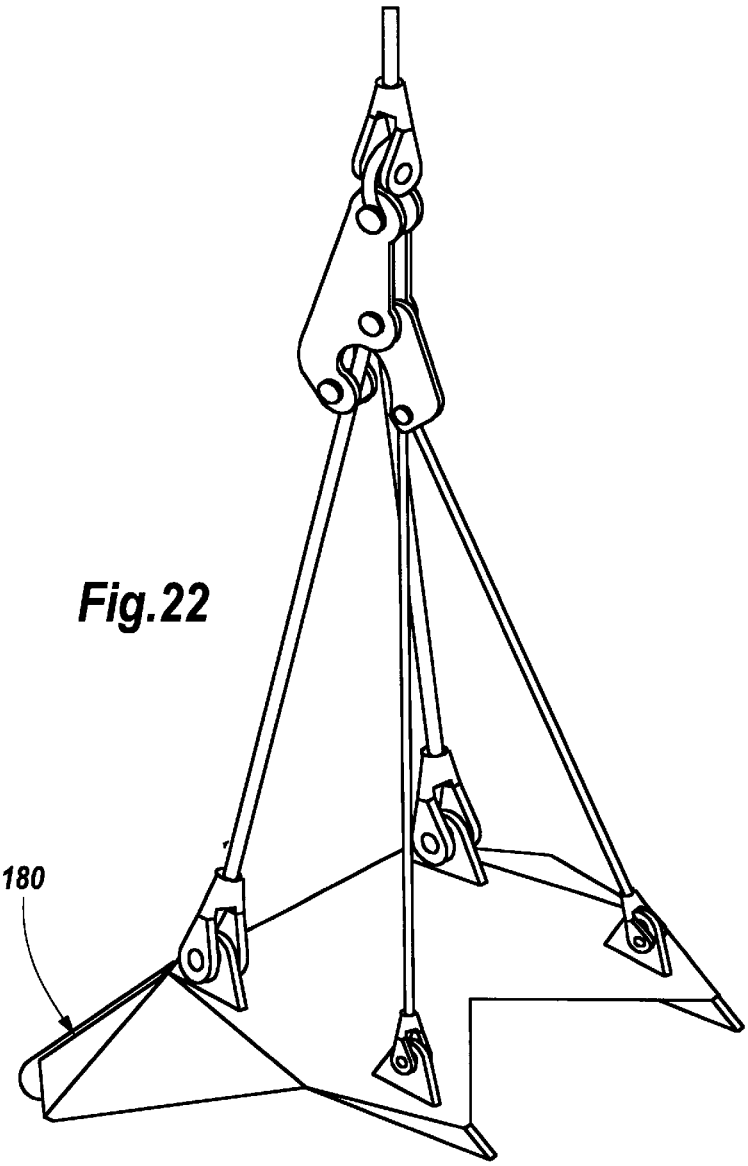
FIG. 22 is an illustration of a first type of vertically loaded anchor useful in the practice of the invention.
Figure 23:
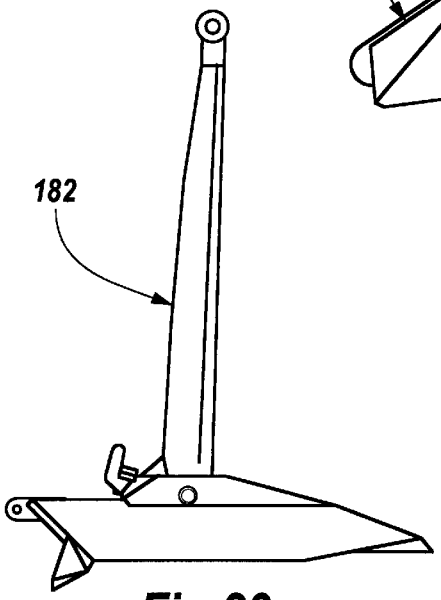
FIG. 23 is an illustration of a second type of vertically loaded anchor useful in the practice of the invention.
Figure 24:
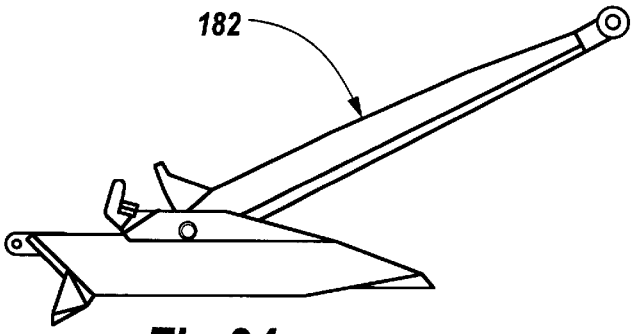
FIG. 24 is an illustration of the vertically loaded anchor of FIG. 23 showing the anchor in the configuration for drag embedment.

Any of the foregoing embodiments of the invention may employ a vertically loaded anchor. Referring to FIGS. 22, 23, and 24, the vertically loaded anchor may comprise a vertically loaded anchor 180 of the type sold by Vryhof under the trademark "STEVMANTA". Alternatively, the vertically loaded anchor may comprise a vertically loaded anchor 182 of the type sold by Bruce under the trademark "DENLA". Vertically loaded anchors are particularly adapted to the practice of the present invention for two reasons. First, vertically loaded anchors are designed and adapted to accommodate and withstand relatively high vertical loads and are therefore particularly adapted for use in conjunction with taut leg mooring legs. Second, vertically loaded anchors are designed and adapted to be recovered after the project for which they are installed has been completed.

Although preferred and alternative embodiments of the invention have been illustrated in the accompanying Drawings and described in the foregoing Detailed Description, it will be understood that the invention is not limited to the embodiments disclosed, but is capable of numerous rearrangements and substitutions of parts and elements without departing from the spirit of the invention. Likewise it being understood, references herein to ocean or sea, are not meant to limit the invention to use in sea or marine environments, as the present invention is equally applicable to freshwater environments.

We claim:

1. A taut leg bow mooring system comprising:

an anchor producing an anchoring force sufficient to remain the anchor fixed on the water body floor under predetermined maximum riser line tension;

a riser line normally secured to and extending from the anchor;

means for releasably connecting the riser line to the anchor;

a submerged buoy secured to the upper end of the riser line, said submerged buoy positioned substantially below the surface of the water body both when the mooring system is connected to a vessel and when said mooring system is not connected to a vessel, said submerged buoy having a first predetermined buoyancy sufficient to maintain the riser line in tension and in a substantially vertical position when said mooring system is not connected to a vessel, thereby minimizing flexure wear of a lower portion of the riser line;

a line having a proximate end secured to the submerged buoy and extending therefrom;

a surface buoy positioned on the surface of the water and having a second predetermined buoyancy sufficient to prevent submergence of the surface buoy at a maximum vessel offset, said surface buoy secured to a distal end of the line connected to and extending from the submerged buoy, said surface buoy adapted to float on the surface of the water body; and a mooring line pivotally connected in the line connected between the submerged buoy and the floating buoy.

2. The taut leg buoy mooring system according to claim 1 wherein the anchor comprises a clump-weight anchor.

3. The taut leg buoy mooring system according to claim 1 wherein the anchor comprises a suction anchor.

4. The taut leg buoy mooring system according to claim 1 wherein the anchor comprises a vertically loaded anchor.

5. The taut leg buoy mooring system according to claim 1 wherein the riser line includes a length of chain at the end thereof which is normally secured to the anchor, and further including a side entry chain receptacle mounted on the anchor for normally securing the chain of the riser line to the anchor.

6. The taut leg buoy mooring system according to claim 1 wherein the submerged buoy comprises an air-filled steel cylinder.

7. The taut-leg buoy mooring system according to claim 1 wherein the line extending between the submerged buoy and the surface buoy is further characterized by:

a triangular plate connected in the line between the submerged buoy and the surface buoy; and a pair of swivels for connecting the triangularly shaped plate to the portion of the line extending therefrom to the submerged buoy and for connecting the triangularly shaped plate to the portion of the line extending therefrom to the surface buoy, respectively.

8. The taut leg buoy mooring system according to claim 7 wherein the mooring line is connected to a third apex of the triangularly shaped plate and includes a floating hawser at the distal end thereof.

9. The taut leg buoy mooring system according to claim 8 wherein the mooring line further includes means for maintaining the portion of the mooring line extending between the triangularly shaped plate and the floating hawser at a predetermined distance below the surf ace of the sea.

10. A taut leg buoy mooring system comprising:

an anchor producing an anchoring force sufficient to maintain the anchor fixed in place relative to the water body floor under predetermined maximum riser line tension;

a riser line normally secured to and extending from the anchor and including a chain section proximate to the anchor;

a side entry chain receptacle mounted on the anchor for normally engaging the chain portion of the riser line to releasably secure the riser line to the anchor;

a submerged buoy comprising an air-filled steel cylinder secured to the end of the riser line remote from the anchor, said submerged buoy position substantially below the surface of the water body both with the mooring system that is connected to a vessel and when the mooring system is not connected to a vessel, said submerged buoy having a first predetermined buoyancy sufficient to maintain the riser line in tension in a substantially vertical position when the mooring system is not connected to a vessel, thereby minimizing flexure wear of the lower portion of the riser line;

a line having a proximate end secured to the submerged buoy and extending therefrom;

a surface buoy positioned on the surface of the water and having a second predetermined buoyancy sufficient to prevent submergence of the surface buoy at maximum vessel offset, said surface buoy secured to the distal end of the line connected to and extending from the submerged buoy, said surface buoy adapted to float on the surface of the water body;

a triangularly shaped plate connected in line extending between the submerged buoy and the surface buoy;

a pair of swivels each connected between the line extending between the submerged buoy and the surface buoy and apex of the triangularly shaped plate for permitting pivotal movement of the triangularly shaped plate relative to the submerged and surface buoys without causing twisting of the line extending therebetween;

a mooring line connected to the third apex of the triangularly shaped plate and including a floating hawser at the distal end thereof;

means for maintaining a portion of the mooring line extending between the triangularly shaped plate and the floating hawser at a predetermined level below the surface of the water body.

* * * * *